US006070559A

United States Patent [19]

Schlesch et al.

[11] Patent Number: 6,070,559

[45] Date of Patent: Jun. 6, 2000

[54] ANNULAR TUBE HEAT EXCHANGER

[75] Inventors: Ronald D. Schlesch, Three Rivers; Michael H. Gaines, Kalamazoo, both of Mich.

[73] Assignee: Armstrong International, Inc., Stuart, Fla.

[21] Appl. No.: 09/316,257

[22] Filed: May 21, 1999

[51] Int. Cl.[7] ..... F22B 7/08

[52] U.S. Cl. ..... 122/140.1; 122/29; 165/158

[58] Field of Search ..... 122/29, 32, 33, 122/127, 140.1, 184, 209.1, 246, 309, 323, 335; 165/157, 158, 164

[56] References Cited

U.S. PATENT DOCUMENTS

| | | |
|---|---|---|
| 757,263 | 4/1904 | Burr . |
| 809,247 | 1/1906 | Burger et al. . |
| 912,069 | 2/1909 | Burr . |
| 1,611,364 | 12/1926 | Parker . |
| 1,754,472 | 4/1930 | Kuenhold . |
| 1,805,165 | 5/1931 | Denney . |
| 2,142,626 | 1/1939 | Anderson et al. . |
| 2,587,530 | 2/1952 | Rossi . |
| 2,664,861 | 1/1954 | Alexander . |
| 3,638,621 | 2/1972 | Craig ..... 122/140.1 |
| 4,162,887 | 7/1979 | Gray ..... 431/28 |
| 4,182,413 | 1/1980 | Kissinger ..... 122/32 |
| 4,738,303 | 4/1988 | Lampe et al. ..... 165/10 |
| 5,775,267 | 7/1998 | Hou et al. ..... 122/33 |
| 5,816,496 | 10/1998 | Kovacs ..... 122/34 |

*Primary Examiner*—Teresa Walberg
*Assistant Examiner*—Gregory A. Wilson
*Attorney, Agent, or Firm*—MacMillan, Sobanski & Todd, LLC

[57] ABSTRACT

An annular tube heat exchanger immersed in a medium, such as a fluid. The heat exchanger comprises a fluid-tight combustion tube including a gas-fired radiant burner for providing a source of heat, at least one heat exchange tube including an inner tube disposed within an outer tube, the outer tube in thermal contact with the combustion tube, the inner tube being open-ended to allow the fluid to pass therethrough, and a fluid-tight combustion tube in thermal contact with the outer tube of the at least one heat exchange tube. The combustion gas from the radiant burner passes through the outer tube of the at least one heat exchange tube to cause an increase in the temperature of the fluid. By providing the maximum amount of heat transfer surface area, the annular tube heat exchanger provides a highly efficient means of increasing the temperature of the fluid.

20 Claims, 3 Drawing Sheets

ANNULAR TUBE HEAT EXCHANGER

BACKGROUND OF THE INVENTION

This invention relates in general to a heat exchanger, and in particular, to an annular tube heat exchanger for a gas-fired steam generator.

Typically, heat exchangers with gas carrying tubes for heating a fluid, for example, water to produce steam may include a plurality of tubes or baffles for directing the flow of combustion gas through the heat exchanger. The tubes or baffles may be arranged in a variety of different configurations. For example, in U.S. Pat. No. 5,816,496 to Kovacs, a flue gas apparatus generally includes planar, vertical inner side walls that can be constructed in an inverted U-shaped configuration. The steam generated in the steam generator is supplied to a humidification apparatus or distributor where the steam is discharged into a moving air stream. The condensate from the steam distributor can be directed back into the water tank of the steam generator. In Kovacs, the combustion burner is supplied with an air-gas mixture regulated by a constant ratio valve and a forced draft means, such as a fan. Further, the combustion process is controlled with a modulating type humidistat associated with the steam distributor to dampen out spikes in demand for more steam. A signal from the humidistat detecting a condition of low humidity generates an increase in the air/gas flow into the burner to generate more steam.

However, it is desirable in any type of heat exchanger to provide the most energy efficient arrangement by maximizing the ratio of heat transfer surface area to the space occupied by the heat exchanger. In addition, it is desirable to provide a heat exchanger in which the combustion gases provide an efficient high velocity heat transfer to the fluid medium. Further, it is desirable to provide a heat exchanger with a simple mechanical structure to reduce manufacturing costs.

SUMMARY OF THE INVENTION

This invention relates to an annular tube heat exchanger. The heat exchanger is immersed in a fluid medium, such as water, air, and the like. The heat exchanger comprises a combustion chamber including a combustion burner for providing a source of heat. The combustion chamber includes at least one opening. The heat exchanger also includes at least one annular heat exchange tube including an inner tube disposed within an outer tube forming a gap therebetween. The outer tube includes at least one opening in fluid communication with the opening of the combustion chamber to allow the heat from the combustion chamber to flow therethrough. The inner tube has open ends to allow the fluid to pass therethrough. The heat exchanger also includes an exhaust chamber having at least one opening to allow the heat from the outer tube of the at least one annular heat exchange tube to flow therethrough. The heat from the combustion burner causes an increase in a temperature of the fluid.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
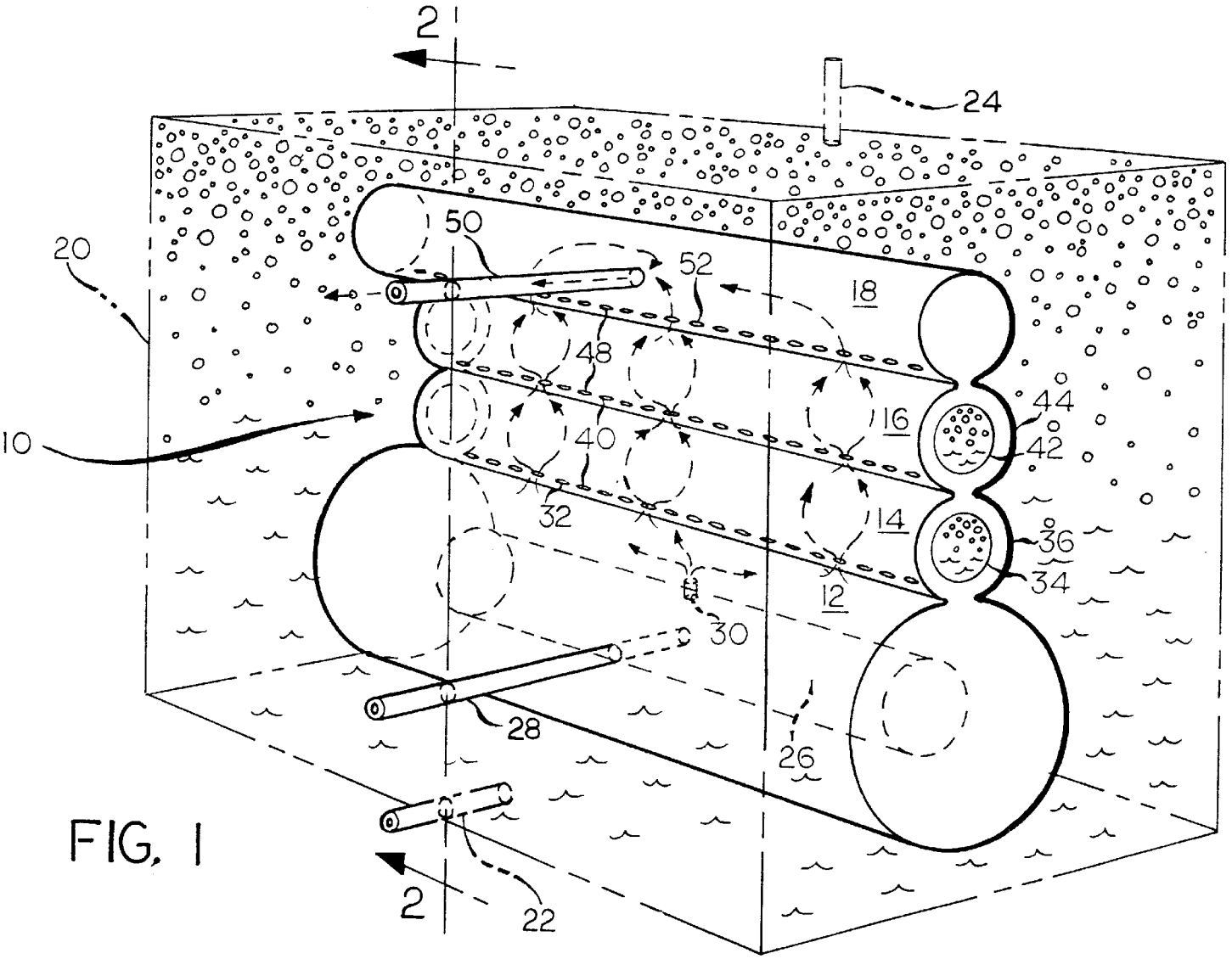
FIG. 1 is a side perspective elevational view of an annular tube heat exchanger according to a preferred embodiment of the invention.
Figure 2:
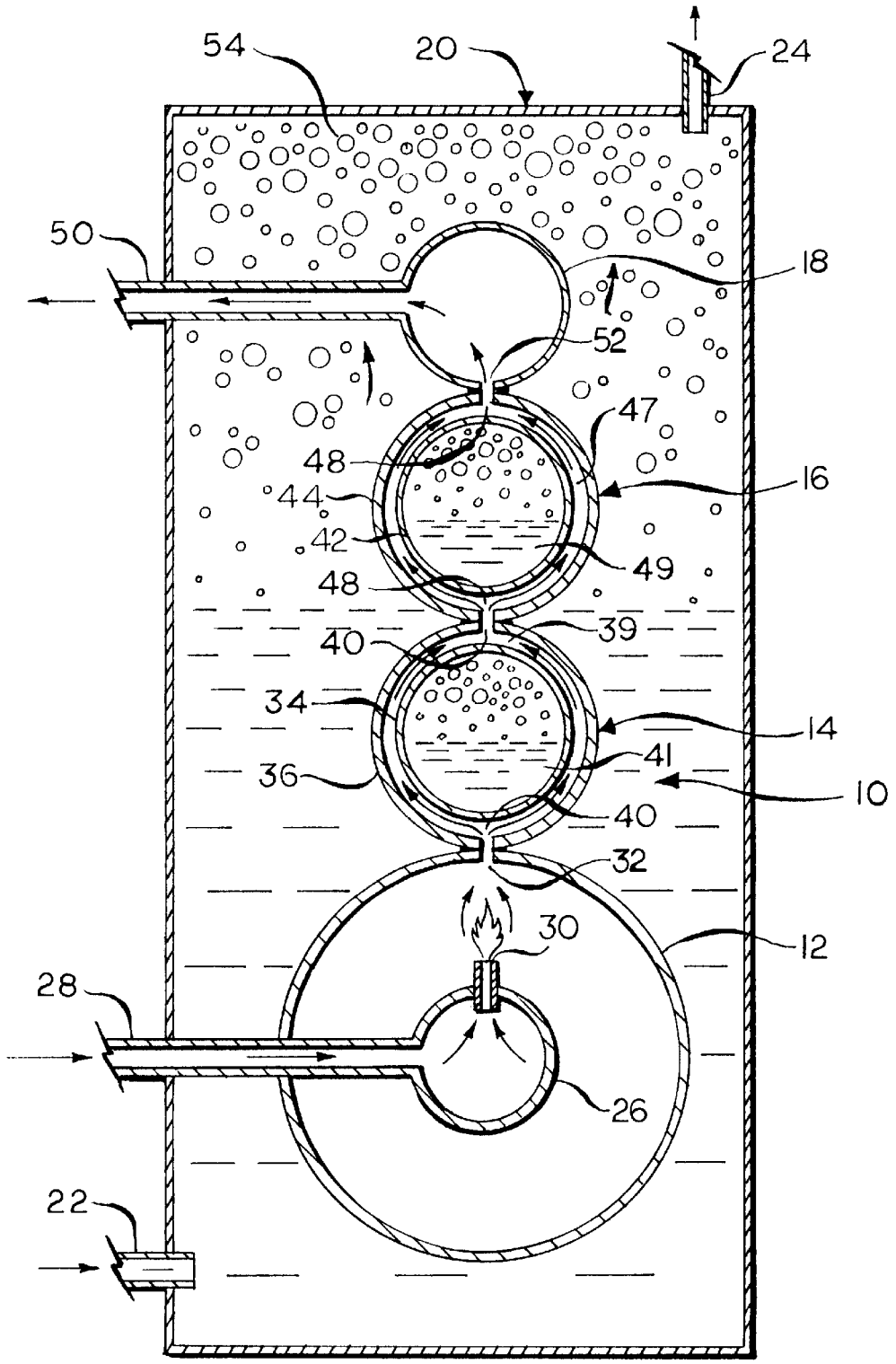
FIG. 2 is a cross sectional view of the annular tube heat exchanger taken along line 2—2 of FIG. 1.
Figure 3:
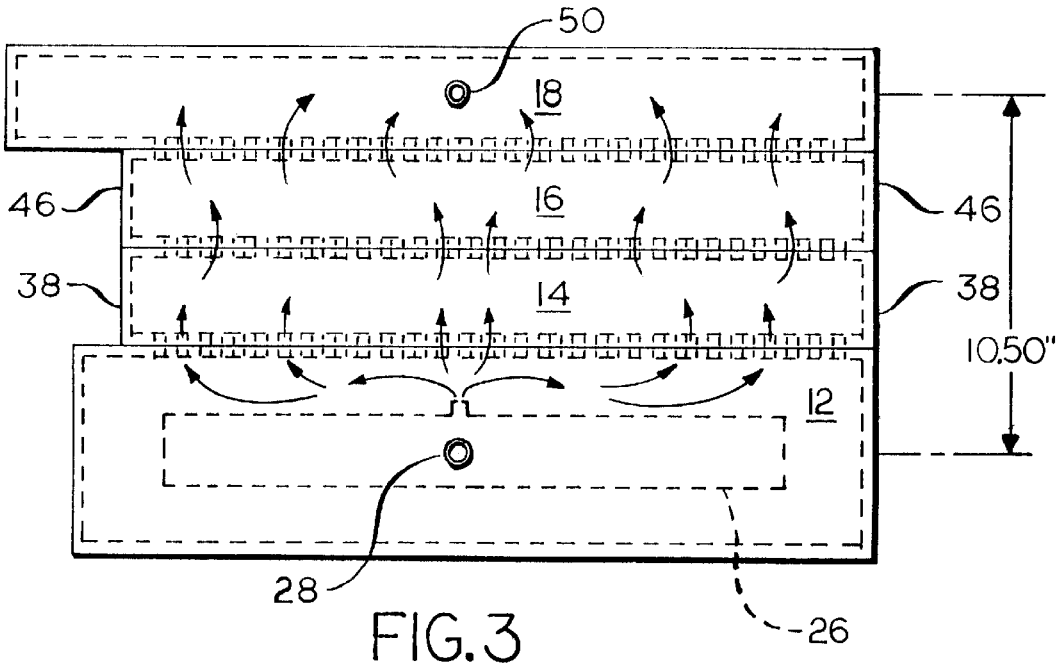
FIG. 3 is a side elevational view of the annular tube heat exchanger.

Referring now to the drawings, there is illustrated in FIGS. 1, 2 and 3, an annular tube heat exchanger, shown generally at 10, according to a preferred embodiment of the invention.

In the preferred embodiment, the annular tube heat exchanger 10 includes a heating chamber, such as a combustion chamber 12, a first annular heat exchange tube 14, a second annular heat exchange tube 16, and an exhaust chamber or tube 18. The combustion chamber 12, the first and second annular heat exchange tubes 14, 16, and the exhaust chamber 18 are preferably made of a material having a suitably high heat transfer coefficient, such as carbon steel, copper, stainless steel 304, and the like. The combustion chamber 12, the first and second annular heat exchange tubes 14, 16, and the exhaust chamber 18 may be securely fastened to each other using means well-known in the art, such as welding, and the like. Preferably, the weld is formed along the length of the tangential intersections or junctions between the combustion chamber 12 and the first annular heat exchange tube 14, the first annular heat exchange tube 14 and the second annular heat exchange tube 16, and the second annular heat exchange tube 16 and the exhaust chamber 18 to form a seal therebetween. A seam spacer (not shown) may be positioned at the junctions to provide support, if necessary.

It is to be understood that the combustion chamber 12 can be any suitable size or shape as long as it provides a source of heat to the heat exchanger 10. Likewise, it is to be understood that the exhaust chamber 18 can be any suitable size or shape as long as it provides an exhaust outlet for the hot gases passing through the heat exchanger 10.

The annular tube heat exchanger 10 is preferably immersed in a container 20, such as a reservoir, tank, and the like, containing a medium, such as a fluid. The medium may be any substance to be heated. For example, the medium may be water, air, and the like. For illustrative purposes only, the medium discussed below is water. The tank 20 may include an inlet 22 for supplying water at a lower temperature than the temperature of the water within the tank 20. The tank 20 may also include an outlet 24 for allowing steam to exit the tank 20.

The annular tube heat exchanger 10 may be of any suitable dimension in order to accommodate the dimensions of the tank 20. In the preferred embodiment, the combustion chamber 12 has an outer diameter of approximately 6.0 inches, a wall thickness of approximately 0.065 inches, and a length of approximately 24.0 inches. The wall thickness of the combustion chamber 12 may be in the range between 0.016 and 0.120 inches. The first and second annular heat exchange tubes 14, 16 have an outer diameter of approximately 2.625 inches, a wall thickness of approximately 0.045 inches, and a length of approximately 22.5 inches. The wall thickness of the first and second annular heat exchange tubes 14, 16 may be in the range between 0.016 and 0.120 inches. The exhaust chamber 18 has an outer diameter of approximately 3.00 inches, a wall thickness of approximately 0.065 inches, and a length of approximately 26.0 inches. The wall thickness of the exhaust chamber 18 may be in the range between 0.016 and 0.120 inches. Thus, the annular heat exchanger 10 has a compact size with a centerline-to-centerline distance between the combustion chamber 12 and is the exhaust chamber 18 of approximately 10.50 inches.

The combustion chamber 12 includes a heat source, preferably a generally cylindrically-shaped radiant burner 26 for supplying heat to the combustion chamber 12 of the annular tube heat exchanger 10. A supply line 28 provides an air/fuel mixture to the gas-fired radiant burner 26. The supply line 28 may be powered by any means well-known in the art, such as a fan, to facilitate the providing of the air/fuel mixture to the radiant burner 26. An opening 30 or series of openings, preferably located at the top of the radiant burner 26, allows the combustion gas from the radiant burner 26 to pass into the combustion chamber 12. It should be understood that the invention is not limited by the type of heat source and that the invention can be practiced with any suitable heat source, such as a gas-fired burner, an oil-fired burner, a resistance heater, and the like.

Figure 4:
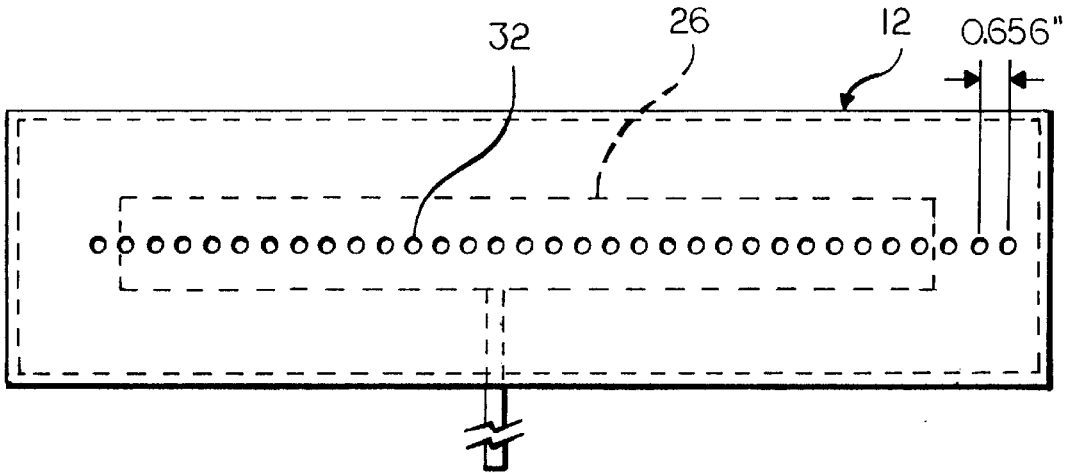
FIG. 4 is a top view of the combustion tube illustrating the openings for allowing the combustion gas to pass through to the annular heat exchange tube.

Each end of the combustion chamber 12 is sealed to prevent the water from entering the combustion chamber 12. As best seen in FIG. 4, the combustion chamber 12 includes a plurality of apertures or openings 32, preferably thirty-three (33), for allowing the exhaust gas from the radiant burner 26 to pass through into the first annular heat exchange tube 14. The openings 32 may be arranged in a linear fashion along one side of the combustion chamber 12. The openings 32 may have a diameter in the range between 0.125 and 1.250 inches. In the preferred embodiment, each opening 32 has a diameter of approximately 0.375 inches, and is spaced from each other a distance of approximately 0.656 inches. It should be appreciated that the number and size of the openings 32 can be varied in order to accomplish the desired flow characteristics in the annular heat exchanger 10.

The first annular heat exchange tube 14 includes an inner tube 34 forming an inner portion and an outer tube 36 forming an outer portion. A spacer ring 38 may be used at each end of the first annular heat exchange tube 14 to provide a means for forming a gap 39 between the inner tube 34 and the outer tube 36. Depending on the diameter of the outer tube 36, the gap 39 may be in the range between 0.040 to 1.000 inches, and more preferably, the gap 39 is in the range of 0.04 to 0.20 inches. In the preferred embodiment, the spacer ring 38 has an inner diameter of approximately 2.655 inches and an outer diameter of approximately 2.872 inches to provide a gap distance of approximately 0.1085 inches between the inner and outer tubes 34, 36. The width or size of the gap 39 can also be a function of the diameter of outer tube 36. Preferably, the gap 39 may be in the range of about 1.0 to 15% of the inside diameter of the outer tube 36, and more preferably about 4.0% of the inside diameter of the outer tube 36. For example, the gap distance for an outer tube 36 having an inside diameter of 10.0 inches can be in the range of about 0.10 to 1.5 inches, and preferably about 0.40 inches. The spacer ring 38 also provides a seal to prevent unwanted water from entering into the gap 39. The gap 39 allows the combustion gas passing through the openings 32 of the combustion chamber 12 to pass between the inner and outer tubes 34, 36. Unlike the combustion chamber 12, the first annular heat exchange tube 14 is open at both ends to allow the water to enter into an open center area 41 defined by the inner tube 34 of the first annular heat exchange tube 14.

In a manner similar to the combustion chamber 12, the outer tube 36 of the first annular heat exchange tube 14 includes a plurality of apertures or openings 40, preferably thirty-three (33), for allowing the combustion gas from the combustion chamber 12 to pass through the gap 39 between the inner and outer tubes 34, 36 and into the second annular heat exchange tube 16. The openings 40 may be arranged in a linear fashion along opposite sides of the outer tube 36. Preferably, the openings 40 may be vertically aligned with the openings 32 of the combustion chamber 12. Alternatively, the openings 40 may be laterally offset from the openings 32 to facilitate mixing of the combustion gas. The openings 40 may have a diameter in the range between 0.125 and 1.250 inches. In the preferred embodiment, the openings 40 have a diameter of approximately 0.375 inches, and are spaced from each other a distance of approximately 0.656 inches. It should be appreciated that the number and size of the openings 40 can be varied in order to accomplish the desired flow characteristics in the annular heat exchanger 10.

In the preferred embodiment, the openings 40 are generally circular in shape. However, it should be appreciated that the invention is not limited by the shape of the openings 40, and that the invention can be practiced with any shape for the openings 40 to produce the desired flow rate through the annular heat exchanger 10. For example, the openings 40 can be oval-shaped, elliptical-shaped, slots, and the like. It should be appreciated that the invention is not limited by the location of the openings 40 and that the invention can be practiced with any arrangement for the openings 40 which provides the desirable combustion gas flow and heat transfer characteristics.

The second annular heat exchange tube 16 is similar in design to the first annular heat exchange tube 14. The second annular heat exchange tube 16 includes an inner tube 42 forming an inner portion and an outer tube 44 forming an outer portion. A spacer ring 46 may be used at each end of the second annular heat exchange tube 16 to provide a means for forming a gap 47 between the inner tube 42 and the outer tube 44. Depending on the diameter of the outer tube 44, the gap 47 may be in the range between 0.040 to 1.000 inches, and more preferably, the gap 47 is in the range of 0.04 to 0.20 inches. In the preferred embodiment, the spacer ring 46 has an inner diameter of approximately 2.655 inches and an outer diameter of approximately 2.872 inches to provide a gap distance of approximately 0.1085 inches between the inner and outer tubes 42, 44. In a manner similar to the first annular heat exchange tube 14, the width or size of the gap 47 of the second annular heat exchange tube 16 can also be a function of the diameter of outer tube 44. Preferably, the gap 47 may be in the range of about 1.0 to 15% of the inside diameter of the outer tube 44, and more preferably about 4.0% of the inside diameter of the outer tube 44. The spacer ring 46 also provides a seal to prevent unwanted fluid from entering into the gap 47. The gap 47 allows the combustion gas passing through the openings 40 of the first annular heat exchange tube 14 to enter into the gap 47 between the inner and outer tubes 42, 44. Also in a manner similar to the first annular heat exchange tube 14, the second annular heat exchange tube 16 is open at both ends to allow the water to enter into an open center area 49 defined by the inner tube 42 of the second annular heat exchange tube 16.

In a manner similar to the combustion chamber 12 and the first annular heat exchange tube 14, the outer tube 44 of the second annular heat exchange tube 16 includes a plurality of apertures or openings 48, preferably thirty-three (33), for allowing the combustion gas from the combustion chamber 12 and the first annular heat exchange tube 14 to pass through the gap 47 between the inner and outer tubes 42, 44 and into the exhaust chamber 18. The openings 48 may be arranged in a linear fashion along opposite sides of the outer tube 44. Preferably, the openings 48 may be vertically aligned with the openings 40 of the first annular heat exchange tube 14. Alternatively, the openings 48 may be laterally offset from the openings 32 to facilitate mixing of the combustion gas. The openings 48 may have a diameter in the range between 0.125 and 1.250 inches. In the preferred embodiment, the openings 48 have a diameter of approximately 0.375 inches, and are spaced from each other a distance of approximately 0.656 inches. It should be appreciated that the number and size of the openings 48 can be varied in order to accomplish the desired flow characteristics in the annular heat exchanger 10.

In the preferred embodiment, the openings 48 are generally circular in shape. However, it should be appreciated that the invention is not limited by the shape of the openings 48, and that the invention can be practiced with any shape for the openings 48 to produce the desired flow rate through the annular heat exchanger 10. For example, the openings 48 can be oval-shaped, elliptical-shaped, slots, and the like. It should be realized that the invention is not limited by the location of the openings 48 and that the invention can be practiced with any arrangement for the openings 48 which provides the desirable combustion gas flow and heat transfer characteristics.

The exhaust chamber 18 includes an outlet 50 for allowing the combustion gas or gases from the radiant burner 26 to exit the annular tube heat exchanger 10. The outlet 50 may be powered by any means well-known in the art to facilitate the exit of combustion gas from the annular tube heat exchanger 10. Similar to the combustion chamber 12, each end of the exhaust chamber 18 is sealed to prevent the water from entering the exhaust chamber 18.

In a manner similar to the combustion chamber 12 and the first and second annular heat exchange tubes 14, 16, the exhaust chamber 18 includes a plurality of apertures or openings 52, preferably thirty-three (33), for allowing the combustion gas from the combustion chamber 12 and the first and second annular heat exchange tubes 14, 16 to pass through the openings 52 and into the exhaust chamber 18. The openings 52 may be arranged in a linear fashion along one side of the exhaust chamber 18. Preferably, the openings 52 are vertically aligned with the openings 52 of the second annular heat exchange tube 16. Alternatively, the openings 52 may be laterally offset from the openings 52 to facilitate mixing of the combustion gas. The openings 52 may have a diameter in the range between 0.125 and 1.250 inches. In the preferred embodiment, the openings 52 have a diameter of approximately 0.375 inches, and are spaced from each other a distance of approximately 0.656 inches. It should be appreciated that the number and size of the openings 52 can be varied in order to accomplish the desired flow characteristics in the annular heat exchanger 10.

In the preferred embodiment, the openings 52 are generally circular in shape. However, it should be appreciated that the invention is not limited by the shape of the openings 52, and that the invention can be practiced with any shape for the openings 52 to produce the desired flow rate through the annular heat exchanger 10. For example, the openings 48 can be oval-shaped, elliptical-shaped, slots, and the like. It should be appreciated that the invention is not limited by the location of the openings 52 and that the invention can be practiced with any arrangement for the openings 52 which provides the desirable combustion gas flow and heat transfer characteristics.

In operation, water enters through the inlet 22 of the tank 20. The radiant burner 26 emits combustion gas within the combustion chamber 12. The heat transfer between the combustion chamber 12 and the water causes an increase in the temperature of the water within the tank 20. The combustion gas then passes through the openings 32 of the combustion chamber 12 and into the gap 39 between outer tube 36 and the inner tube 34 of the first annular heat exchange tube 14. The heat transfer between the inner and outer tubes 34, 36 of the first annular heat exchange tube 14 and the water causes an increase in the temperature of the water within the tank 20. The combustion gas then passes through the openings 40 and enters the gap 47 between the inner and outer tubes 42, 44 of the second annular heat exchange tube 16. In a manner similar to the first annular heat exchange tube 14, the heat transfer between the inner and outer tubes 42, 44 increases the temperature of the water in the tank 20. The combustion gas then passes through the openings 48 and enters the exhaust chamber 18. The heat transfer between the exhaust chamber 18 and the water further increases the temperature of the water in the tank 20. The combustion gas then exits the exhaust chamber 18 through the outlet 50. The increase in the temperature of the water from the combustion chamber 12, the first and second annular heat exchange tubes 14, 16, and the exhaust chamber 18 causes steam to form in the tank 20. The steam rises through the generally static fluid in the tank 20 and exits through the outlet 24 at the top 54 of the tank 20.

As described above, it can be appreciated that the generally cylindrical-shaped combustion chamber 12, the annular heat exchange tubes 14, 16, and the generally cylindrically-shaped exhaust chamber 18 exposes the water to a greater amount of heat transfer surface area than conventional heat exchangers. Thus, the annular tube heat exchanger of the invention provides a highly efficient means of increasing the temperature of the water. In addition, the enclosed space or gap between the inner and outer tubes is very limited. Thus, the combustion gas achieves a high velocity as it passes through this area of the annular tube heat exchanger, thereby reducing or eliminating pockets of static gases within the gaps 39, 47. Further, the stacking arrangement of the tubes and the interconnection of the matching holes or slots of each tube allows the combustion gas to pass through as many tubes as needed to achieve the percentage of heat transfer required for a particular application.

It should be appreciated that the invention is not limited by the number of annular heat exchange tubes and that the invention can be practiced with any suitable number of annular heat exchange tubes to produce the desired amount of heat transfer to the water. It should also be appreciated that the invention is not limited by the generally vertical arrangement of the combustion chamber, the heat exchange tubes, and the exhaust chamber, as given in the illustrated example, and that the invention can be practiced with any desirable arrangement, such as horizontally, diagonally, or any other suitable arrangement in which they are connected together.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An annular tube heat exchanger immersed in a fluid, comprising:

a combustion chamber including a combustion burner for providing a source of heat, the combustion chamber including at least one opening;

at least one annular heat exchange tube including an inner tube disposed within an outer tube forming a gap therebetween, the outer tube including at least one opening in fluid communication with the opening of the combustion chamber to allow the heat from the combustion chamber to flow between the inner tube and the outer tube, the inner tube having open ends to allow the fluid to pass therethrough; and an exhaust chamber having at least one opening to allow the heat from the outer tube of the at least one annular heat exchange tube to flow therethrough, wherein the heat from the combustion burner causes an increase in a temperature of the fluid.

2. The heat exchanger according to claim 1, wherein the gap is a function of an inside diameter of the outer tube.

3. The heat exchanger according to claim 1, wherein the gap is in the range of about 1% to 15% of the inside diameter of the outer tube.

4. The heat exchanger according to claim 1, wherein a wall thickness of one of the combustion chamber and the exhaust chamber is in the range between approximately 0.016 to 0.120 inches.

5. The heat exchanger according to claim 1, wherein a wall thickness of one of the inner tube and the outer tube of the at least one heat exchange tube is in the range between approximately 0.016 to 0.120 inches.

6. The heat exchanger according to claim 1, wherein the combustion burner comprises a radiant burner.

7. An annular tube heat exchanger, comprising:

a heating chamber for providing a source of heat, the heating chamber including at least one opening;

at least one annular heat exchange tube having an inner portion and an outer portion, the inner portion in thermal contact with the fluid, the outer portion in fluid communication with the heating chamber; and an exhaust chamber in fluid communication with the outer portion of the at least one annular heat exchange tube, wherein the heat from the heating chamber passes between the outer portion and the inner portion of the at least one annular heat exchange tube, and wherein the heat from the at least one annular heat exchange tube passes through the exhaust chamber, thereby causing an increase in a temperature of the fluid.

8. The heat exchanger according to claim 7, further comprising a spacer positioned between the inner and outer portions of the at least one annular heat exchange tube to form a gap therebetween.

9. The heat exchanger according to claim 8, wherein the gap is a function of an inside diameter of the outer portion of the at least one annular heat exchange tube.

10. The heat exchanger according to claim 9, wherein the gap is in the range of about 1% to 15% of the outer portion of the at least one annular heat exchange tube.

11. The heat exchanger according to claim 7, wherein the heating chamber, the at least one annular heat exchange tube, and the exhaust chamber are all immersed in the fluid.

12. The heat exchanger according to claim 7, wherein the heating chamber, the at least one annular heat exchange tube, and the exhaust chamber include at least one opening for allowing the heat to flow between the outer portion and the inner portion of the at least one annular heat exchange tube.

13. The heat exchanger according to claim 7, wherein the ends of the inner tube of the at least one heat exchange tube are open to allow the fluid to pass therethrough.

14. The heat exchanger according to claim 7, wherein a wall thickness of one of the combustion chamber and the exhaust chamber is in the range between approximately 0.016 to 0.120 inches.

15. The heat exchanger according to claim 7, wherein a wall thickness of one of the inner portion and the outer portion of the at least one heat exchange tube is in the range between approximately 0.016 to 0.120 inches.

16. The heat exchanger according to claim 7, wherein the source of heat comprises a radiant burner.

17. An annular tube heat exchanger immersed in a medium, comprising:

a heating chamber for providing a source of heat, the heating chamber including at least one opening;

a plurality of heat exchange tubes, each heat exchange tube including an inner tube disposed within an outer tube forming a gap therebetween, the outer tube including at least one opening for allowing the heat from the heating chamber to flow between the inner tube and the outer tube, the inner tube being open-ended to allow he medium to flow therethrough; and an exhaust chamber including at least one opening for allowing the heat from one of the plurality of heat exchange tubes to flow therethrough, wherein the heat from the heating chamber causes an increase in a temperature of the medium.

18. The heat exchanger according to claim 17, wherein the gap is a function of an inside diameter of the outer tube.

19. The heat exchanger according to claim 17, wherein a wall thickness of one the plurality of heat exchange tubes is in the range between approximately 0.016 to 0.120 inches.

20. The heat exchanger according to claim 17, wherein the source of heat comprises a combustion burner.

* * * * *